US005751784A

United States Patent [19]

Enck

[11] Patent Number: 5,751,784

[45] Date of Patent: May 12, 1998

[54] X-RAY TUBE

[75] Inventor: Richard S. Enck, San Jose, Calif.

[73] Assignee: Kevex X-Ray, Scotts Valley, Calif.

[21] Appl. No.: 722,343

[22] Filed: Sep. 27, 1996

[51] Int. Cl.[6] ..... H01J 5/18

[52] U.S. Cl. ..... 378/140; 378/119; 378/161

[58] Field of Search ..... 378/119, 121, 378/123, 137, 138, 140, 141, 145, 161

[56] References Cited

U.S. PATENT DOCUMENTS 4,926,452 5/1990 Baker et al. ..... 378/137

5,199,054 3/1993 Adams et al. ..... 378/138

5,206,895 4/1993 Danos ..... 378/121

*Primary Examiner*—Don Wong

*Attorney, Agent, or Firm*—Benman & Collins

[57] ABSTRACT

An x-ray rube having an electron gun for generating a beam of electrons along a first axis. The beam of electrons impinges upon an anode which emits x-rays in response to the beam of electrons. The anode is mounted in parallel with the first axis. Coils are included for deflecting the electron beam onto the anode.

10 Claims, 2 Drawing Sheets

X-RAY TUBE

BACKGROUND OF THE INVENTION

1. Field of the Invention

The present invention relates to an x-ray tube. More specifically, the present invention relates to x-ray tubes capable of generating high intensity x-rays without a loss or reliability 2. Description of the Related Art X-ray tubes normally include an electron gun and an anode. A beam of electrons generated by the electron gun is focused to a focal spot on the anode and x-rays are generated by the interaction of the beam of electrons with the atoms of the anode. These x-rays are generated in all directions from the anode in the region surrounding the focal spot. Typically, the anode is substantially surrounded by an evacuated housing in which a window is formed to allow some of the x-rays to pass out of the housing, the window typically comprising a thin foil of a low atomic number metal, such as beryllium or aluminum, having a high transmission coefficient for x-radiation.

X-ray tubes have a number of applications which involve the treatment or analysis of a sample, for example: industrial imaging, analytical instruments and medical imaging. For such applications, it is often desirable to have an x-ray tube which has a long service life, which is capable of forming a small focal spot and which is also capable of generating a high intensity of x-radiation at the sample.

Increasing the current due to the beam of electrons (the beam current) is an effective method of increasing the power output of an x-ray tube and can also increase the intensity of x-rays at the sample. However, since only a small fraction of the energy of the beam of electrons is converted to x-rays, the majority of electrons are either scattered by the anode or lose their energy to heat in the anode. This generation of heat within the anode can cause the anode to melt, preventing the further use of the x-ray tube without repair.

There are many factors which can influence the maximum beam current that can be used without melting the anode. For example, the anode material should be chosen to have a high melting point and a high thermal conductivity. However, in order to improve the efficiency of x-ray generation, the anode may be made of a metal of high atomic number. In order to meet this dual requirement the anode is commonly comprised of copper (which has a high terminal conductivity) coated with a layer of tungsten (which has a high atomic number and a high melting point). Enlarging the focal spot, say by reducing the angle a at which the electrons are incident upon the anode, can increase the maximum beam current by enhancing heat dissipation. However, increasing the size of the focal spot can adversely affect the resolution achievable for imaging applications, and decreasing a can result in an increase in the generation of scattered electrons. The problems of scattered electrons and resolution are both discussed below.

In addition, the anode may be kept cool by rotating it so that the position of the focal spot on the anode is continually changed as the anode rotates. Such rotating anodes have a greater ability to dissipate heat energy than fixed anodes. Finally, anodes are usually cooled by passing a fluid, such as water or oil, through the anode to transport the heat away from the anode.

A second method of increasing the intensity of the x-rays at the sample is to decrease distance from the focal spot to the window (the exit distance). This is because a small exit distance allows the sample to be positioned closer to the focal spot. Optimizing the exit distance, and hence the proximity of the sample to the focal spot, can also improve magnification for the imaging applications mentioned above. Unfortunately, decreasing the exit distance can also increase the number of scattered electrons which are incident upon the window, thus causing heating of the window. Furthermore, decreasing the exit distance exacerbates the effect on the window of heat radiated from the anode. Heating of the window can be a significant source of poor reliability, particularly if the window is comprised of beryllium. Beryllium has a low heat capacity and has a low thermal conductivity so that significant temperature gradients can be formed across a beryllium window which may cause the window to rupture.

A number of solutions have been adopted to the problem of window heating due to scattered electrons. One approach has been to employ a magnetic field in the region between the anode and the window in order to deflect electrons away from the window. The use of such a magnetic field is described in U.S. Pat. No. 5,206,895. Negatively biasing a metallic mesh placed between the anode and the window can also result in the electrons being deflected away from the window. Such an arrangement is disclosed in "An introduction to X-ray Spectrometry", pp. 57–58 by Ron Jenkins. The use of magnetic or electric fields to deflect electrons away from the window limits the minimum value of exit distance than can be employed. If a weak electric or magnetic field is used then the exit distance must be large so that the path of the electrons is sufficiently deflected to prevent damage to the window. If a strong electric or magnetic field is used then the exit distance must also be large to prevent interference with the beam of electrons which are incident upon the anode. The use of magnets or biased electrodes also occupies space between the anode and the window, preventing the exit distance from being reduced. Furthermore, the use of an electrode to which a potential is applied will require the provision of insulators and feedthroughs, thus increasing complexity.

X-rays generated by the electron beam are emitted from the anode in all directions, but usually only x-rays having a limited range of take-off angles $\beta$ (the angle between an x-ray and the surface of the anode) are used to illuminate the sample under test. The selection of values of $\beta$ for x-rays used in the treatment of analysis of an object, can be as important as the choice of $\alpha$. For example, the use of x-rays having small values of $\beta$ can improve resolution for imaging applications, and can also reduce the formation of undesirable penumbra for x-ray lithographic applications. Furthermore, x-rays emitted at small values of $\beta$ can have a higher intensity than those emitted at large values of $\beta$ though this effect can be offset by absorption in the anode.

As we have seen, therefore, the parameters of an x-ray tube are interrelated and optimizing one parameter may lead to the worsening of another. For example, the use of x-ray having small take-off angles $\beta$ can improve resolution, but can also lead to a loss of intensity due to absorption in some ways, but can lead to rapid degradation of the window. Furthermore, attempts to optimize a such as those suggested in U.S. Pat. No. 5,206,895, may lead to an increase in the exit distance and hence to loss of intensity.

Accordingly, it is an object of the present invention to provide an x-ray tube in which the above mentioned disadvantages are reduced. Particularly, it is an object of the present invention to provide an x-ray tube which is capable of generating high intensity x-rays without loss of reliability.

SUMMARY OF THE INVENTION

In accordance with the above mentioned objects, there is provided an x-ray tube comprising:

(a) means for generating a beam of electrons;

(b) an anode, said beam of electrons being focused to be incident upon a focal spot on the anode, said incident angle $\alpha$ between 0° and 25° relative to the anode surface, x-rays and scattered electrons being generated at the anode by said incident beam of electrons; and (c) a housing which substantially encloses the anode, said housing having a window formed in it through which x-ray may pass;

said x-ray tube being characterized by the provision of a barrier means in the form of a wall disposed between the focal spot and the window, so that scattered electrons are prevented from reaching the window by the barrier means, at least a portion of said barrier means comprising one or more x-ray permeable wall portions, said x-ray permeable wall portions allowing x-rays to pass through the barrier means towards the window but substantially preventing the passage of electrons.

Preferably, said barrier means further includes at least one opaque wall portion, the or each said opaque wall portion being impermeable to x-rays, at least one exit aperture being formed in said opaque wall portion or portions, the or each said exit aperture being closed by said x-ray permeable wall portion or portions.

Advantageously, the or each said x-ray permeable wall portion is made from a material having a high melting point and a high transmission coefficient for x-rays. Preferably said material also has a high thermal conductivity. Further preferably, the said material is diamond.

Preferably, the dimensions and position of the or each said exit aperture are such that only x-rays having take-off angles in the range 0° to 20° are able to pass through the or each said exit aperture.

Advantageously, the or each said opaque wall portion comprises a material having a high thermal conductivity. Preferably the or each said opaque wall portion comprises a material having a high thermal conductivity. Further preferably the or each said opaque wall portion is formed of copper.

Advantageously, the incident angle $\alpha$ is between 5° and 15°. Further advantageously, the incident angle $\alpha$ is between 7° and 13°.

Preferably, the largest dimension of the focal spot is between 1 μm and 100 μm. Further preferably said largest dimension is between 1 μm and 25 μm.

Typically the window comprises a thin sheet of beryllium foil. Conveniently the distance from the focal spot to the window is in range 2 to 8 mm.

According to another aspect, the invention provides a barrier means for use in an x-ray tube as described above.

BRIEF DESCRIPTION OF THE DRAWINGS

An example of the invention will now be described in greater detail with reference to the accompanying drawings, which are provided by means of example only and in which.

DESCRIPTION OF THE INVENTION

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Figure 1:
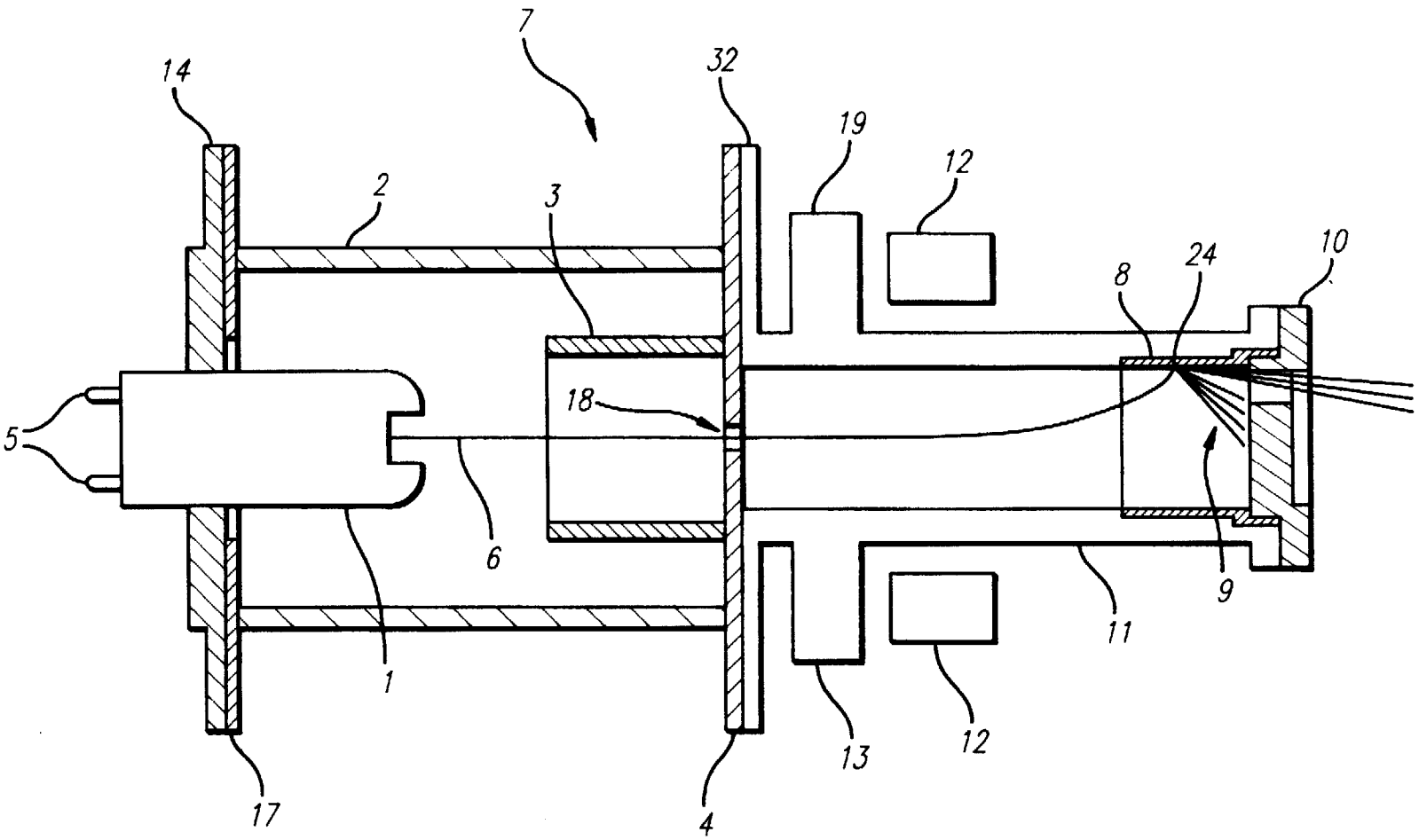
FIG. 1 is a schematic diagram of an x-ray tube according to the invention.

FIG. 1 illustrates an x-ray tube generally indicating by 7 comprising an anode 8 and a means for generating a beam of electrons, said means comprising an electron gun 1 which is of standard design. The electron gun 1 and the anode 8 are both disposed inside an evacuated housing comprising an end plate 14, a ceramic tube 2, a first weld flange 17, a second weld flange 4, an anode tube 11 and a window assembly 10. The pressure within the evacuated housing is less than $10^{-6}$ torr. The electron gun 1 is provided with electrical connectors 5 for the supply of power to the electron gun 1. The electron gun 1 protrudes from and is hermetically sealed to the end plate 14. The end plate 14 is welded to the first weld flange 17 which is in turn brazed to the ceramic tube 2. The ceramic tube 2 is brazed to the second weld flange 4. The ceramic 2 is brazed to the second weld flange 4. The ceramic tube 2 insulates the first weld flange 17 from the second weld flange 4, so that the second weld flange 4 can be maintained at ground potential and the first weld flange 17 can be maintained at −50 kV. A stainless steel tube is welded to the second weld flange 4 so that the stainless steel tube 3 is at ground potential.

One end of the anode tube 11 is formed into a flange 32 which is welded to and is in electrical contact with the second weld flange 4. Anode 8 is brazed to an in electrical contact with the inside of the anode tube 11, so that both the anode tube 11 and anode 8 are at ground potential. The anode 8 is comprised of copper and the anode tube 11 is comprised of stainless steel. The anode 8 is cooled by passing water through a cavity 16 (shown in FIG. 2 only) formed in the anode tube 11. The water passes into the cavity 16 through an inlet tube 19 which is welded to the anode 11. Baffles (not shown) within the cavity 16 restrict the flow of the water so that the water is forced into contact with the anode 8. After flowing against the anode 8 the water passes out of the anode tube 11 through an outlet tube 1 which is welded to the anode tube 22.

A beam of electrons 6, which is generated by the electron gun 1, has a potential of −50 kV relative to ground on exiting the electron gun 1. The beam current can have a range of values: from a few microamps up to ten milliamps. The beam of electrons 6 is accelerated toward the second weld flange 4 by the potential difference between the weld flange 4 and the electron gun 1, and passes through the entrance aperture 18. The beam of electrons 6 is deflected by a magnetic deflection coil 12 so that it impinges upon the anode 8 an incident angle ac (shown in FIG. 2) of approximately 10°. The beam of electrons 6 forms a focal spot 24 on the anode 8. The anode 8 is coated with a layer of tungsten (not shown) in the area surrounding the focal spot 24 to form a suitable surface from which x-rays 9 may be generated. The x-rays 9 are generated in all directions from the anode 8 in the region surrounding the focal spot 24. The beam of electrons 6 has diameter approximately 5 μm, but the small incident angle $\alpha$ results in the largest dimension of the focal spot 24 being approximately 25 μm. The focal spot 24 has a larger area than would be the case for a large incident angle and thus the heat generated per unit area is reduced. Those x-rays 9 which have appropriate take-off angles pass through the window assembly 10 shown in more detail in FIG. 2.

Figure 2:
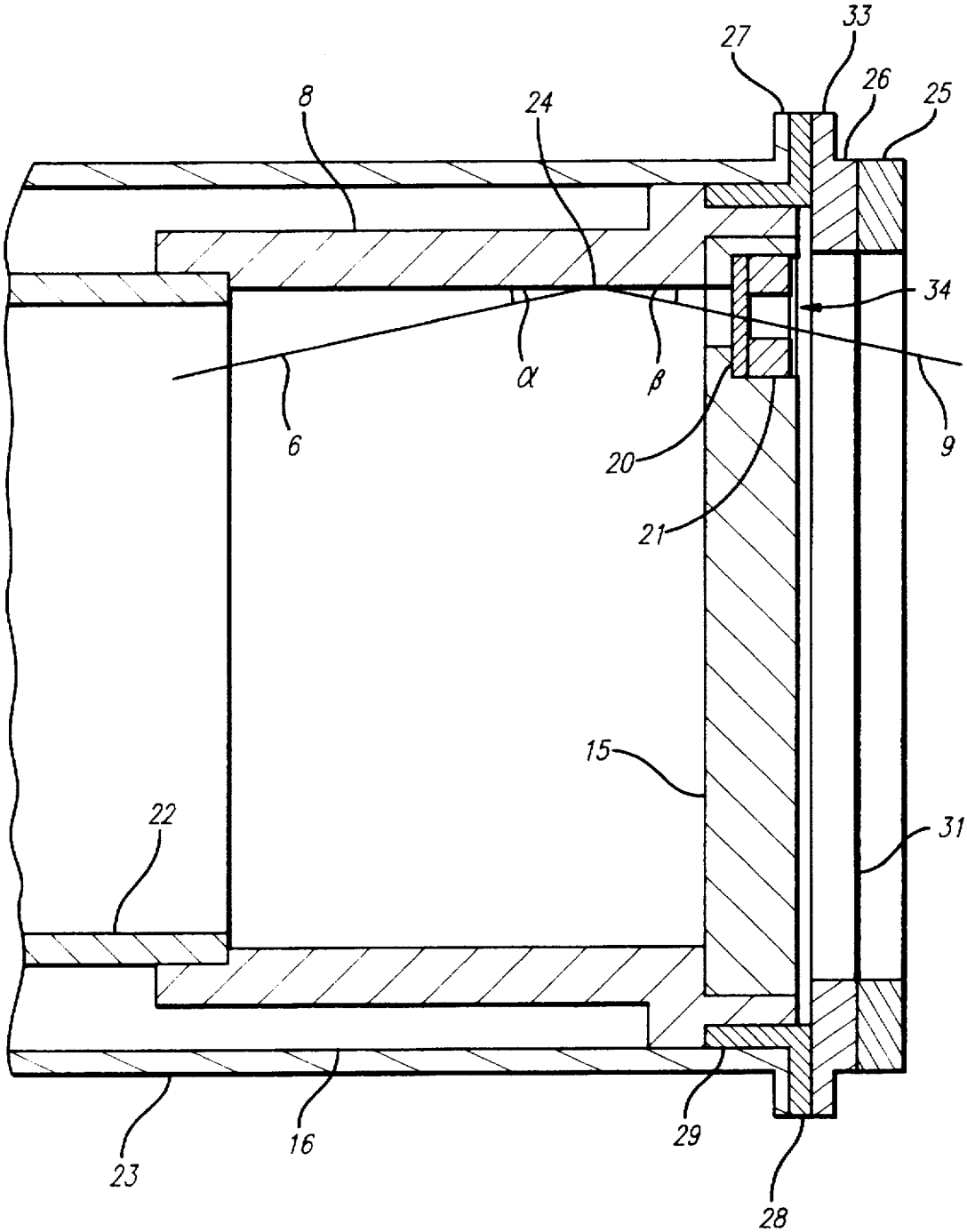
FIG. 2 is a more detailed diagram of part of the x-ray tube shown in FIG. 1.

FIG. 2 shows a more detailed representation of the x-ray tube 7 in the region which surrounds the anode 8. An opaque wall portion comprising a copper plate 15, is brazed to and is in electric contact with the anode 8. An exit aperture 4, which is formed in the copper plate 15, is closed by an x-ray permeable wall portion comprising a diamond sheet 20. The diamond sheet 20 is held in place by a retaining ring 21. X-rays 9, which have appropriate take-off angles, pass through the diamond sheet 20 before being transmitted to the exterior of the x-ray tube 7 by a window 31. The spacing between the diamond sheet 20 and the window 31 is approximately 1.5 mm and the spacing between the diamond sheet 20 and the focal spot 24 is approximately 1.5 mm. The window 31 comprises a sheet of beryllium which is brazed to both an upper ring 25 and a lower ring 26, the lower ring 26 having a ring flange 33. The ring flange 33 is welded to a tube flange 28 which is formed from a short section of metal tube 29. The window 31 is mounted on the anode tube 11, which includes an outer tube 23 and an inner tube 22, by inserting the metal tube 29 inside the outer tube 23. A vacuum tight seal is achieved by welding the tube flange 28 to a flange 27 formed from the outer tube 23. The metal tube 29, inner tube 22 and the outer tube 23 are all comprised of stainless steel. The upper ring 25 and lower ring 26 are comprised of Monel (a nickel alloy).

FIG. 2 shows the incident angle $\alpha$ at which the electron beam 6 is incident upon the anode 8 and also shows a take-off angle $\beta$ at which one of the x-rays 9 is emitted from the anode 8. Those x-rays 9 which are emitted by the x-ray tube 7 have values of $\beta$ limited by the position and dimensions of the aperture 34 to the approximate range 0° to 20°. The position and dimensions of the aperture 34 enables the use of the x-ray tube 7 for imaging applications in which a high resolution and high x-ray flux is required. The high resolution is achievable because the apparent size of the focal spot 24, when viewed through the exit aperture 34, is much smaller than its real size. Viewed through the center of the exit aperture 34, the length and width of the focal spot 24 appear to be approximately equal. The interaction of the beam of electrons 6 with the anode 8 results in the formation of scattered electrons (not shown) which are ejected from the anode 8 in a range of directions. The small value of $\alpha$ results in large numbers of scattered electrons being directed towards the window 31. If the diamond sheet 20 were not present, the window 31 would be subject to severe heating as a result of collisions from the scattered electrons. Scattered electrons are also prevented from reaching the window 31 by the copper plate 15. Because the copper plate 15 has a low transmission coefficient for x-rays, unwanted x-rays having values of $\beta$ greater than 20° are prevented from exiting the window 31.

The barrier means, which comprises the diamond sheet 20 and copper plate 15, prevents scattered electrons from colliding with the window 31 while allowing some of the x-rays 9 to pass from the anode 8 to the window 31. Diamond has a high melting temperature and thus the diamond sheet 20 is able to withstand the heat generated by impact with the scattered electrons. Diamond and copper are both good thermal conductors, so that heat is conducted away from the window 31 thus preventing damage to the window 31 by radiated heat. The use of the barrier means in conjunction with small incident angle a results in an x-ray tube 7 which is capable of increased power output without loss of reliability.

Thus, the present invention has been described herein with reference to a particular embodiment for a particular application. Those having ordinary skill in the art and access to the present teachings will recognize additional modifications applications and embodiments within the scope thereof.

It is therefore intended by the appended claims to cover any and all such applications, modifications and embodiments within the scope of the present invention.

Accordingly,

What is claimed is:

1. An x-ray rube comprising:

first means for generating a beam of electrons along a first axis;

second means for emitting x-rays in response to said beam of electrons, said second means including an anode mounted off-axis with respect to said first axis;

third means for deflecting said electron beam onto said anode; and a housing within which said first, second and third means are disposed, said housing including:

a first x-ray permeable window, barrier means disposed between said anode and said window for protecting said window from electrons scattered by said beam from said anode, said barrier means having an exit aperture formed therein, said exit aperture being mounted relative to said anode such that only x-rays having take-off angles of 0 to 30 degrees relative to a surface of the anode are able to pass through the exit aperture, and a second x-ray permeable window provided in said exit aperture.

2. The invention of claim 1 wherein the incident angle of said electron beam on said anode is between 5 and 15 degrees relative to a surface of said anode.

3. The invention of claim 1 wherein said second window is mounted within an x-ray impermeable plate.

4. The invention of claim 3 wherein said second window is diamond.

5. The invention of claim 3 wherein said plate is copper.

6. An x-ray rube comprising:

first means for generating a beam of electrons along a first axis;

second means for emitting x-rays in response to said beam of electrons, said second means including an anode mounted off-axis with respect to said first axis; and third means for deflecting said electron beam onto said anode whereby an incident angle of said electron beam on said anode is between 5 and 15 degrees relative to a surface of said anode;

a housing within which said first, second and third means are disposed;

a first x-ray permeable window disposed within said housing;

barrier means disposed between said anode and said window for protecting said window from electrons scattered by said beam from said anode, said barrier means having an exit aperture formed therein, said exit aperture being mounted relative to said anode such that only x-rays having take-off angles of 0 to 30 degrees relative to a surface of the anode are able to pass through the exit aperture; and a second x-ray permeable window in said exit aperture.

7. The invention of claim 6 wherein said second window is diamond.

8. The invention of claim 6 wherein said second window is mounted within an x-ray impermeable plate.

9. The invention of claim 8 wherein said plate is copper.

10. An x-ray rube comprising:

first means for generating a beam of electrons along a first axis;

second means for emitting x-rays in response to said beam of electrons, said second means including an anode mounted off-axis with respect to said first axis;

third means for deflecting said electron beam onto said anode; and a housing within which said first, second and third means are disposed, said housing including:

a first x-ray permeable window, barrier means disposed between said anode and said window for protecting said window from electrons scattered by said beam from said anode, said barrier means having an exit aperture formed therein, and a second x-ray permeable window provided in said exit aperture.

* * * * *